US008687325B2

(12) United States Patent
Premerlani et al.

(10) Patent No.: US 8,687,325 B2
(45) Date of Patent: Apr. 1, 2014

(54) MICRO-ELECTROMECHANICAL SWITCH PROTECTION IN SERIES PARALLEL TOPOLOGY

(75) Inventors: William James Premerlani, Scotia, NY (US); Kathleen Ann O'Brien, Niskayuna, NY (US); Owen Jannis Schelenz, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 1080 days.

(21) Appl. No.: 12/209,064

(22) Filed: Sep. 11, 2008

(65) Prior Publication Data

US 2010/0061024 A1 Mar. 11, 2010

(51) Int. Cl.
*H01H 9/30* (2006.01)
*H01H 73/18* (2006.01)

(52) U.S. Cl.
USPC ..... 361/13; 361/2; 361/6; 361/7; 361/8

(58) Field of Classification Search
USPC ..... 361/2, 6, 7, 8, 13
See application file for complete search history.

(56) References Cited

U.S. PATENT DOCUMENTS

| | | | | | |
|---|---|---|---|---|---|
| 3,040,232 | A | * | 6/1962 | Healis | 361/837 |
| 3,202,904 | A | * | 8/1965 | Madland | 323/350 |
| 3,532,976 | A | * | 10/1970 | Adelaar et al. | 324/419 |
| 3,859,568 | A | * | 1/1975 | Sakshaug | 361/128 |
| 4,122,415 | A | * | 10/1978 | Luther et al. | 332/152 |
| 4,236,099 | A | * | 11/1980 | Rosenblum | 315/83 |
| 4,692,643 | A | * | 9/1987 | Tokunaga et al. | 327/436 |
| 5,235,147 | A | * | 8/1993 | Pham et al. | 218/144 |
| 6,055,161 | A | * | 4/2000 | Church et al. | 363/22 |
| 6,459,559 | B1 | * | 10/2002 | Christofersen | 361/124 |
| 6,738,246 | B1 | * | 5/2004 | Strumpler | 361/93.1 |
| 6,741,435 | B1 | * | 5/2004 | Cleveland | 361/2 |
| 6,940,363 | B2 | * | 9/2005 | Zipper et al. | 333/103 |
| 7,079,363 | B2 | * | 7/2006 | Chung | 361/13 |
| 7,332,835 | B1 | | 2/2008 | Wright et al. | |
| 7,382,634 | B2 | * | 6/2008 | Buchmann | 363/59 |
| 7,605,456 | B2 | * | 10/2009 | Obu et al. | 257/680 |
| 7,643,256 | B2 | | 1/2010 | Wright et al. | |

(Continued)

FOREIGN PATENT DOCUMENTS

| | | | |
|---|---|---|---|
| CN | 1452194 | A | 10/2003 |
| CN | 101226835 | A | 7/2008 |

(Continued)

OTHER PUBLICATIONS

Christopher M. Doelling et al., Nanospot welding and contact evolution drying cycling of a model microswitch, Journal of Applied Physics, Jun. 18, 2007, vol. 101, Issue 12, pp. 124303-124303-7.

(Continued)

*Primary Examiner* — Rexford Barnie
*Assistant Examiner* — Zeev V Kitov
(74) *Attorney, Agent, or Firm* — Jason K. Klindtworth

(57) ABSTRACT

An electrical switching device is presented. The electrical switching device includes multiple switch sets coupled in series. Each of the switch sets includes multiple switches coupled in parallel. A control circuit is coupled to the multiple switch sets and configured to control opening and closing of the switches. One or more intermediate diodes are coupled between the control circuit and each point between a respective pair of switch sets.

23 Claims, 4 Drawing Sheets

(56) References Cited

U.S. PATENT DOCUMENTS

| | | | |
|---|---|---|---|
| 2004/0080964 | A1 | 4/2004 | Buchmann |
| 2007/0139829 | A1 | 6/2007 | Arthur et al. |
| 2008/0164961 | A1 | 7/2008 | Premerlani et al. |

FOREIGN PATENT DOCUMENTS

| | | | |
|---|---|---|---|
| DE | 1562121 | A1 | 2/1970 |
| EP | 2056315 | A2 | 5/2009 |
| JP | 11054263 | A | 2/1999 |
| JP | 2008136345 | A | 6/2008 |
| JP | 2008192597 | A | 8/2008 |

OTHER PUBLICATIONS

Search Report and Written Opinion from corresponding EP Application No. 09169531 dated Mar. 26, 2012.
Unofficial English translation of Office Action from JP dated Sep. 3, 2013.

* cited by examiner

MICRO-ELECTROMECHANICAL SWITCH PROTECTION IN SERIES PARALLEL TOPOLOGY

BACKGROUND

The invention relates generally to protection of switching devices, and more particularly, to protection of micro-electromechanical system based switching devices.

A circuit breaker is an electrical device designed to protect electrical equipment from damage caused by faults in a circuit. Traditionally, most conventional circuit breakers include bulky electromechanical switches. Unfortunately, these conventional circuit breakers are large in size thereby necessitating use of a large force to activate the switching mechanism. Accordingly, to employ electromechanical contactors in power system applications, it may be desirable to protect the contactor from damage by backing it up with a series device that is sufficiently fast acting to interrupt fault currents prior to the contactor opening at all values of current above the interrupting capacity of the contactor.

As an alternative to slow electromechanical switches, fast solid-state switches have been employed in high speed switching applications. As will be appreciated, these solid-state switches switch between a conducting state and a non-conducting state through controlled application of a voltage or bias. For example, by reverse biasing a solid-state switch, the switch may be transitioned into a non-conducting state. However, since solid-state switches do not create a physical gap between contacts when they are switched into a non-conducting state, they experience leakage current. Furthermore, solid-state switches are used in a combination of series parallel topology that includes one or more arrays of switches that facilitate higher voltage and current handling capabilities. However, the arrays of switches open or close asynchronously, resulting in an undesirable magnitude of load current flowing through the switches. Accordingly, the load current may exceed the current handling capabilities of the switches causing shorting or welding and rendering the switches inoperable. Therefore, there is a need for enhanced protection of such an array of switches.

BRIEF DESCRIPTION

Briefly, an electrical switching device is presented. The electrical switching device comprises a plurality of switch sets coupled in series, each switch set comprising a plurality of switches coupled in parallel. The electrical switching device further comprises a control circuit coupled to the plurality of switch sets and configured to control opening and closing of the switches. The electrical switching device further comprises one or more intermediate diodes coupled between the control circuit and each point between a respective pair of switch sets.

In another embodiment, an electrical switching system is presented. The electrical switching system comprises a switching circuitry comprising a micro-electromechanical system switch configured to switch the system from a first switching state to a second switching state. The electrical switching system further comprises a voltage draining circuitry coupled to the switching circuitry, wherein the voltage draining circuitry is configured to drain a voltage at contacts of the switching circuitry. The electrical switching system further comprises a control circuitry coupled to the voltage draining circuitry, wherein the control circuitry is configured to form a pulse signal, and wherein the pulse signal is applied to the voltage draining circuitry in connection with initiating an operation of the switching circuitry.

In another embodiment, a method of protecting an electrical switching device is presented. The method comprises triggering a current pulse into at least one pair of diodes via a control circuit, wherein the at least one pair of diodes are coupled between a plurality of switch sets and the control circuit. The method further comprises biasing the at least one pair of diodes based upon the triggering. The method further comprises discharging a voltage across the plurality of switch sets via biasing of the pair of diodes.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

In accordance with embodiments of the invention, structural and/or operational relationships, as may be used to provide voltage scalability (e.g., to meet a desired voltage rating) in a switching array based on micro-electromechanical systems (MEMS) switches are described herein. Typically, MEMS refer to micron-scale structures that, for example, can integrate a multiplicity of functionally distinct elements, e.g., mechanical elements, electromechanical elements, sensors, actuators, and electronics, on a common substrate through micro-fabrication technology. It is contemplated, however, that many techniques and structures presently available in MEMS devices will be available via nanotechnology-based devices, e.g., structures that may be smaller than 100 nanometers in size. Further, it will be appreciated that MEMS based switching devices, as referred to herein, may be broadly construed and not limited to nanotechnology based devices or micron-sized devices.

Figure 1:
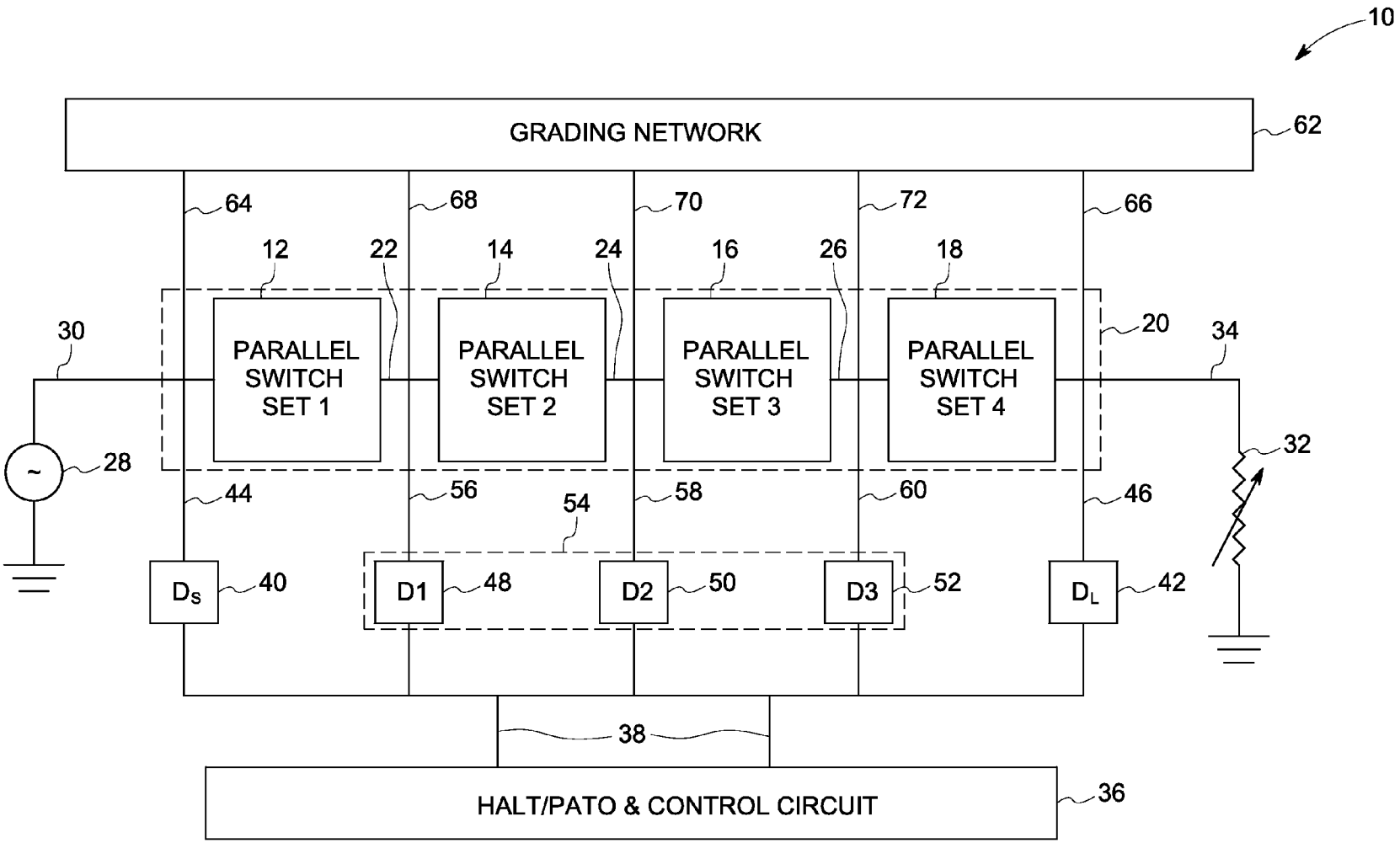
FIG. 1 is a block diagram of a micro-electromechanical systems (MEMS) based parallel switch sets in a series configuration including a protection circuitry according to an aspect of the invention.

FIG. 1 is a block diagram of MEMS based parallel switch sets in a series configuration according to an aspect of the invention. The MEMS based switch sets 10 (also referred to as switching circuitry) includes a switch 20 coupled between an electrical source 28, via an upstream connection 30, and a load 32, via a downstream connection 34 and configured to facilitate or interrupt a flow of current between the source 28 and the load 32. The switch 20 further includes a plurality of switch sets 12, 14, 16, and 18 coupled in series, each switch set having a plurality of switches coupled in parallel. In one aspect of the invention, the plurality of switches in each parallel switch set 12, 14, 16 and 18 is constructed using MEMS switches. For example, the switch set 12 includes multiple MEMS switches connected in parallel. Although in FIG. 1 the switch 20 illustrates multiple MEMS switch sets, it will be appreciated that the switch 20 may comprise a single MEMS switch set. Parallel switch sets 12, 14, 16, and 18 are further coupled in series via connections 22, 24, and 26. Parallel switch sets connected in series have advantages of increased current carrying capabilities and increased voltage capabilities. In another embodiment, more than four parallel switch sets may be connected in series to achieve desired current and voltage ratings.

Referring again to FIG. 1, a control circuit 36 is coupled via terminals 38 to the line-side diode ($D_S$) 40, load-side diode ($D_L$) 42, and an intermediate diode block 54. The control circuit 36 is configured to control the diodes (by providing a forward bias voltage) at an instance of opening (turn-off) and/or closing (turn-on) of the switch 20 by way of a pulse signal. An example of a pulse signal may include a current pulse and/or a voltage sufficient enough to forward bias the diodes. The control circuit 36 facilitates forward biasing of diodes 40, 42 and the diodes in the intermediate diode block 54, at an appropriate time of the switching cycle, to activate a conduction mode in the diodes. In one embodiment, control circuitry 36 is configured to provide an appropriate voltage level for forward biasing the diodes through terminal 38. In one embodiment, the control circuit includes a Hybrid Arc Limiting Technology (HALT) and/or a Pulse Assisted Turn On (PATO) circuitry.

One or more pairs of diodes are coupled between the control circuit 36 and each point between a respective pair of switch sets 12, 14, 16 and 18. The line-side diode ($D_S$) 40 is coupled across the parallel switch set 12 and the control circuit 36. Similarly, a load-side diode ($D_L$) 42 is coupled across the parallel switch set 18 and the control circuit 36. According to one embodiment of the invention, the line-side diode ($D_S$) 40 and the load-side diode ($D_L$) 42 are configured to carry a bulk of load current. In the illustrated embodiment, the intermediate diode block 54 includes intermediate diodes (D1) 48, (D2) 50, and (D3) 52 that are coupled respectively across each point between the switch set 12, 14, 16 and 18 through connections 56, 58, and 60. It may be appreciated that, intermediate diodes (D1) 48, (D2) 50, and (D3) 52 may carry relatively lesser load current compared to the line-side diode ($D_S$) and load-side diode ($D_L$). According to an aspect of the present technique, diodes (line-side, load-side and intermediate) may be referred to as voltage draining circuitry as they are configured to drain the voltage across each switch sets 12, 14, 16 and 18 at an instance when the switch 20 is operational (turn-on and/or turn-off).

A grading network 62 is coupled to the switch 20 at each point between the parallel switch sets 12, 14, 16 and 18 though connection 64 on the line-side, connection 66 on the load-side and via connections 68, 70, and 72 at intermediate locations. In one embodiment, the grading network 62 is configured to distribute voltage equally across the switch sets 12, 14, 16 and 18. In an exemplary embodiment, the grading network 62 is configured to protect the switch 20 from voltage and current spikes.

Figure 2:
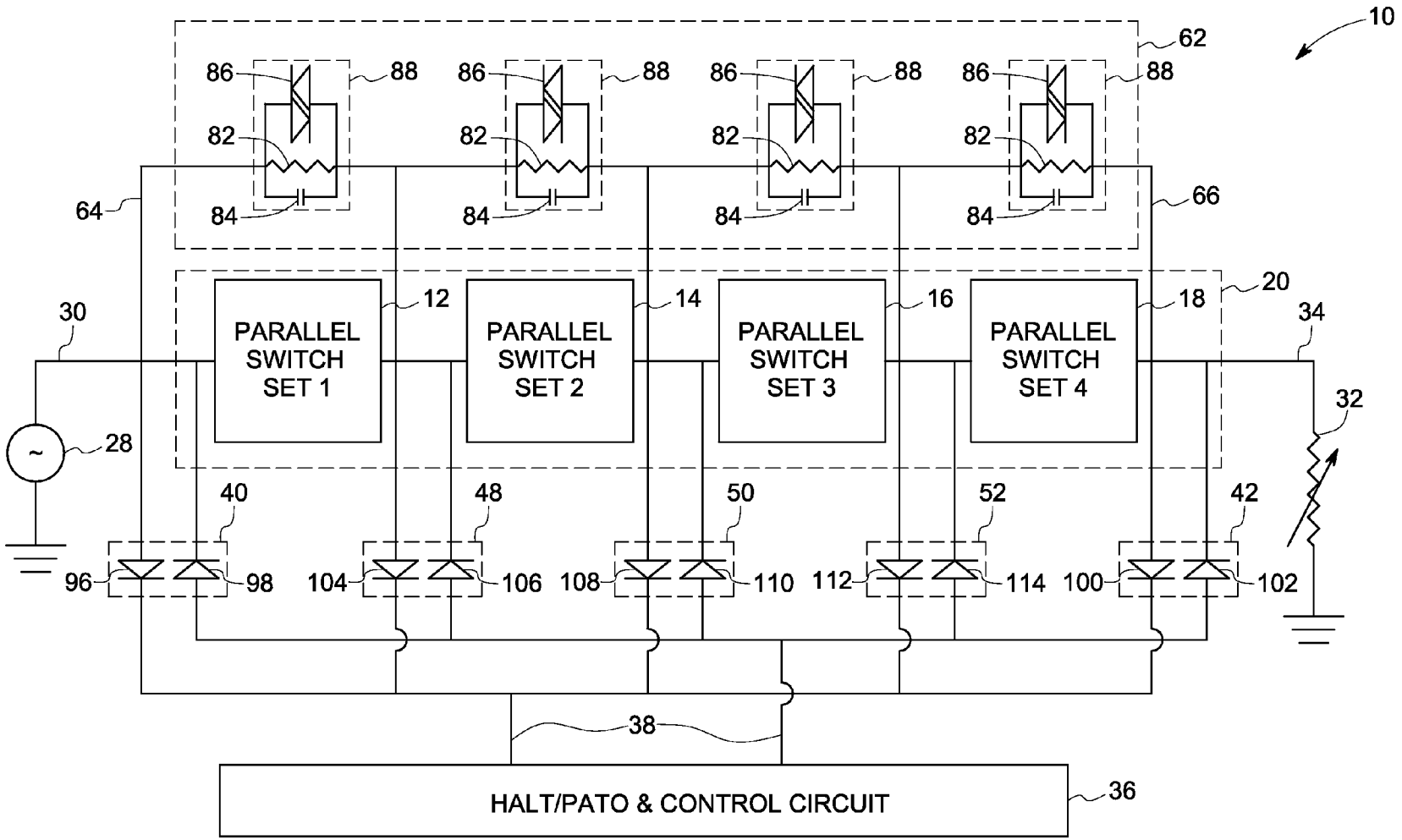
FIG. 2 is a further block diagram of a MEMS based parallel switch sets in FIG. 1 including an exemplary protection circuitry.

Turning now to FIG. 2, further detailed embodiments of the diodes 40, 42, 48, 50 and 52 and the grading network 62 of FIG. 1 are illustrated. The grading network 62 further includes multiple blocks 88. Each of such blocks 88 includes a resistor 82, a capacitor 84 and a non-linear voltage clamping device 86. The block 88 is coupled to the switch 20 at multiple locations at the line-side via connection 64, the load-side via connection 66 and intermediate points via connections 68, 70, and 72 as referenced in FIG. 1. The grading network 62 typically helps in spreading the voltage equally across the multiple switch sets 12, 14, 16, and 18. It may be noted that unequal voltage across the multiple parallel switch sets 12, 14, 16 and 18 may result in excessive voltage across one switch set resulting in damage. In an exemplary embodiment, the non-linear voltage clamping device 86 that is part of the grading network 62 is configured to suppress a rapid rate-of-change of voltage that may also be referred to as 'over voltages'. The non-linear devices 86 may also be configured to absorb inductive energy that may be released during interruption of inductive loads and/or faults. Examples of non-linear devices may include, but are not limited to, varistors and metal oxide varistors.

It may be noted that, when an array of MEMS switches is turned on, the switches do not all close at exactly the same time. Such asynchronous switching may result in closing of a single switch set to complete the circuit connection between source and load resulting in full load current flow in one switch set. A single switch set may not be configured to carry the load current resulting in welded contacts within and permanent damage. Control circuit 36 is used to forward bias the diodes (line-side, load-side, and intermediate) during an instance of turn-on of the switch 20. The forward bias on the diodes completes the power circuit and collapses the voltage across the MEMS switches while they are being closed and while current builds in the load circuit. During turn-on, the pulse is applied first, while the contacts are closed. The contacts close during the pulse, the load current flows through the switches when the pulse is over.

Similarly, during turn-off when the contacts of the switch 20 are still closed but contact pressure is diminishing due to the switch opening process, the switch resistance increases. Due to increased resistance, excessive load current may flow in one switch set resulting in damage if switched asynchronously, as noted above. Control circuit 36 is configured to forward bias the diodes (line-side, load-side, and intermediate) at an instance of turn-off. Forward biasing results in diodes conducting and, in turn, causes the load current to start to divert from the MEMS switch 20 into the diodes. In this present condition, the diode bridge presents a path of relatively low impedance to the load circuit current and protecting the switch 20 from excessive current. Accordingly, as noted above, during the instance of turn-on and/or turn-off, load current may be diverted into the diodes at line-side, load-side, and intermediate locations, as will be described in detail in the following paragraph.

A line-side diode 40 is coupled between the control circuit 36 and the switch 20 at a point closer to the source 28. Similarly, the load-side diode 42 is coupled to a point between the control circuit 36 and the switch 20 at a point closer to the load 32. The line-side diode 40 further includes a pair of diodes generally referred to as turn-on diode 96 and turn-off diode 98. Similarly the load-side diode 42 includes turn-on diode 100 and turn-off diode 102. Furthermore, intermediate diodes 48, 50, and 52 are coupled at intermediate positions between the parallel switch sets 12, 14, 16, 18, and the control circuit 36. The intermediate diodes 48, 50, and 52 include respectively turn-on diodes 104, 108, 112 and turn-off diodes 106, 110, and 114.

Typically, the line-side diode 40 is configured in such a way that the turn-on diode (96, 100) activates during the instance of turn-on when the switch 20 is about to be closed (begin to conduct load current). Similarly the turn-off diode (98, 102) activates during the instance of turn-off when the switch 20 is about to be opened (stop conducting load current). In an exemplary embodiment, turn-on diodes 96, 100, 104, 108, and 112 are forward biased at turn-on. Typically, during turn-on, the voltage across each parallel switch set 12, 14, 16, and 18 is desired to be zero that is achieved by forward biasing the turn-on diodes 96, 100, 104, 108 and 112. Similarly, during turn-off, the voltage across the parallel switch sets 12, 14, 16, and 18 is desired to be equal to avoid unequal voltage distribution that may damage certain switch sets 12, 14, 16 and/or 18 and an alternate path for the decreasing load current (least resistance path). In an exemplary embodiment, forward biasing the turn-off diodes 98, 102, 106, 110, and 114 at turn-off provides alternate path for the load current and equal voltage distribution across the parallel switch sets 12, 14, 16, and 18.

It may be appreciated by one skilled in the art, that the diodes carry the load current during their operation and require sufficient current rating as the load current. However, it may be noted that the bulk of the load current may flow through the line-side diode 40 and the load side diode 42. Therefore, lower rating diodes may be employed as intermediate diodes 48, 50 and 52, as compared to the line-side diode 40 or load-side diode 42. It may be noted that the burden on the control circuit 36 that supplies a pulse to forward bias the diodes does not increase substantially by engaging such lower rating intermediate diodes 48, 50 and 52. In one embodiment, similarly rated diodes are selected for diodes 40, 42, 48, 50, and 52. However, multiple parallel branches of diodes may be employed for the line-side diode 40 and load-side diode 42. In another embodiment, higher rated diodes may be selected for the line-side and load-side diodes 40 and 42 and lower rated diodes may be selected for the intermediate diodes 48, 50 and 52. However, it may be noted that, diode properties such as low forward drop voltage may be selected for all the diodes (line-side, load-side and intermediate) to facilitate lower current burden on the control circuit.

Figure 3:
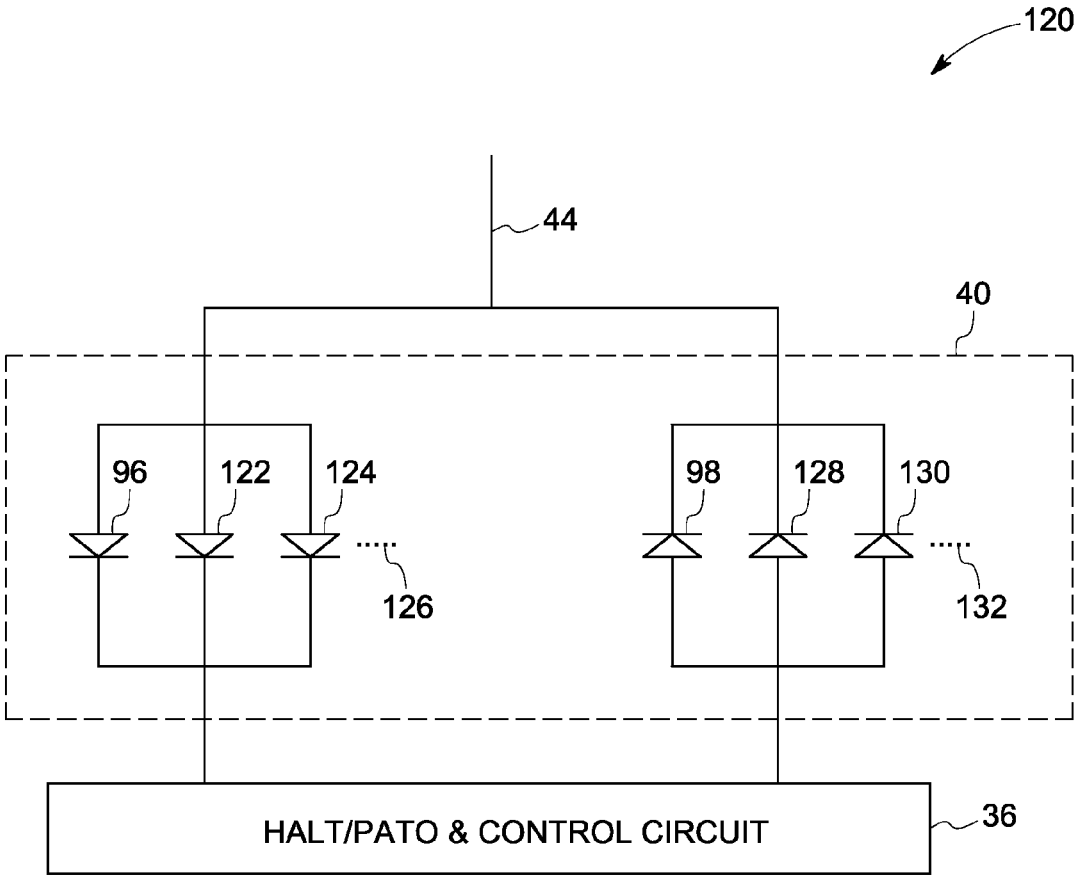
FIG. 3 is a magnified view of a diode pair employed in the protection circuitry of FIG. 2.

FIG. 3 is a magnified view of the line-side diode 40 employed in FIG. 2. In an exemplary embodiment, the illustrated embodiment of the line-side diode 40, as indicated by reference numeral 120, includes multiple turn-on diodes 96, 122, and 124 and multiple turn-off diodes 98, 128, and 130. It may be noted that many such diode branches may be included as referenced by numerals 126 and 132. Diode 40 illustrated herein is for example. Further, such diode configurations, as illustrated by the diode 120, may be implemented for other diodes such as load-side diode and intermediate diodes, previously described.

Figure 4:
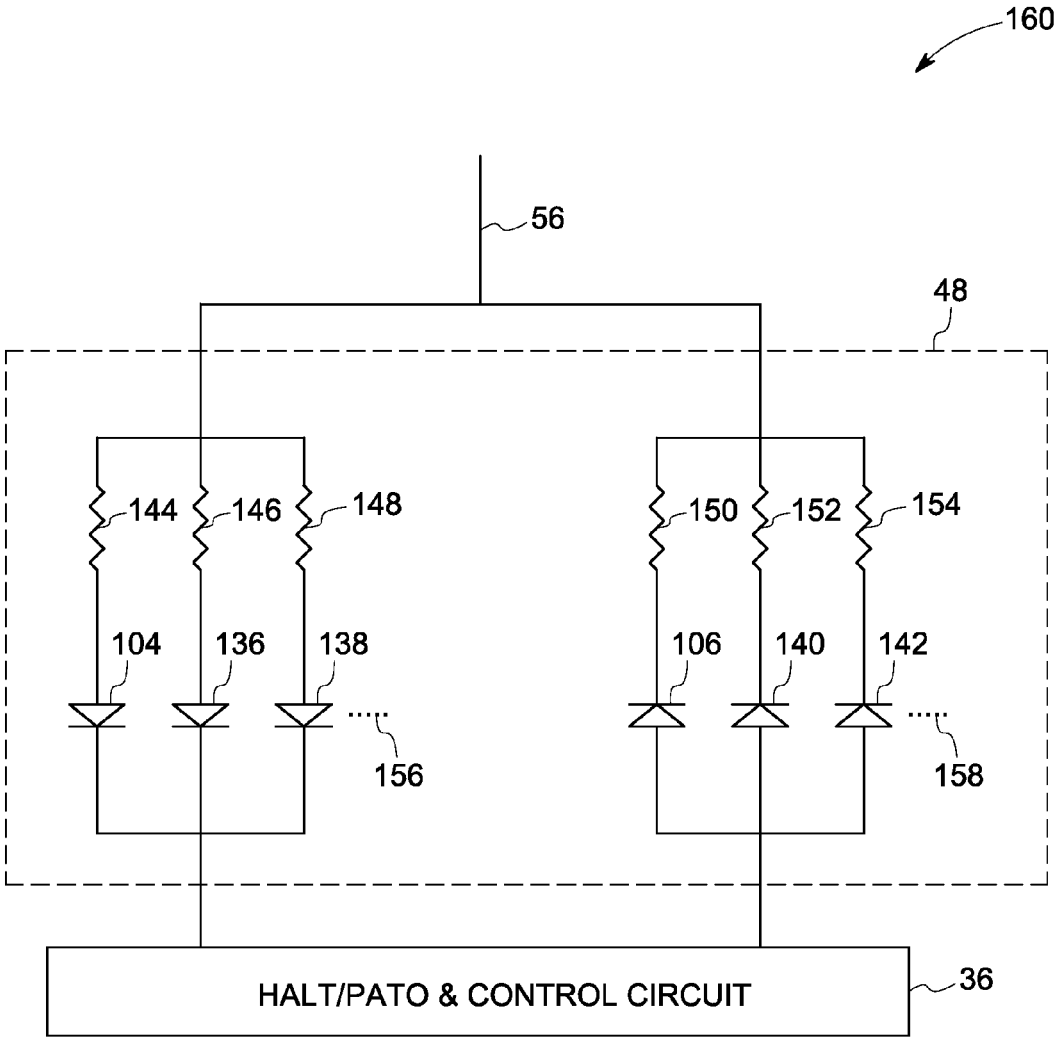
FIG. 4 is a magnified view of a further embodiment of the diode pair as implemented in FIG. 2.

FIG. 4 illustrates one embodiment of an intermediate diode, such as the intermediate diode 48 that may be implemented in FIG. 2. As will be appreciated, while only a single intermediate diode 48 is illustrated for simplicity, this embodiment may be employed to in each of the intermediate diodes 48, 50 and 52. The magnified view of the intermediate diode 48 includes series resistors 144, 146, and 148 coupled respectively to the turn-on diodes 104, 136, and 138. Similarly, series resistors 150, 152, and 154 are coupled respectively to the turn-off diodes 106, 140, and 142. The intermediate diode 48 may carry lesser load current than the line-side and/or load-side diodes 40 and 42, as discussed above. The resistors that are coupled in series with the diodes further restrict the load current that may flow though the intermediate diodes 48, 50 and 52. Furthermore, limiting the current in the intermediate diodes 48, 50 and 52 also reduces the load requirements (burden) on the control circuit 36, as the bulk of the current will flow through the line-side diode and/or load-side diode. Further, multiple diode branches may be included in parallel as illustrated by the reference numeral 156 and 158 depending on the current carrying capabilities required and the load current (burden) handling capacity of the control circuit 36.

Advantageously, such diode arrangements and grading network as described herein, helps in achieving equal voltage distribution across the switches. Employing such diode configurations substantially reduces effects of stray capacitance and RC time constant difference between various components of the circuit. Intermediate diodes ensure that voltage is clamped to zero across each switch in a multiple switch configuration. Further, reduced current rating of the intermediate diodes may not cause an extra burden on the control circuit that drives the diodes.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A device comprising:

a plurality of micro-electromechanical system switch sets coupled in series at common points, each switch set comprising a plurality of switches coupled in parallel between a first common point and a second common point;

a control circuit coupled to the plurality of switch sets and configured to control opening and closing of the switches; and one or more intermediate diodes coupled between the control circuit and a common point between each respective pair of the plurality of switch sets.

2. The device of claim 1, wherein the control circuit is configured to forward bias the intermediate diodes during closing of the switches.

3. The device of claim 1, wherein the control circuit is configured to forward bias the intermediate diodes during opening of the switches.

4. The device of claim 1, comprising a grading network coupled across each switch set.

5. The device of claim 4, wherein the grading network is coupled to a point upstream of the plurality of switch sets, and to a point downstream of the plurality of switch sets, and to points between each adjacent pair of switch sets.

6. The device of claim 5, wherein the grading network includes a resistor, a capacitor and a varistor coupled in parallel with each switch set.

7. The device of claim 1, wherein a line-side diode and a load-side diode are coupled between the control circuit and respectively, a point on a line-side and a point on a load-side of the switch sets, wherein the control circuit is configured to forward bias the line-side diode and the load-side diode.

8. The device of claim 7, wherein the line-side diode and the load-side diode have a higher current rating than the intermediate diodes.

9. The device of claim 7, wherein each of the line-side diode and the load-side diode comprises a plurality of diodes electrically coupled in parallel to effectively form pairs of diodes having a higher current capacity than the intermediate diodes.

10. The device of claim 9, wherein each diode of the parallel coupled diodes is substantially identical to each of the intermediate diodes.

11. The device of claim 1, wherein the intermediate diodes further comprises series resistors.

12. The device of claim 1, further comprising a pair of line-side diodes coupled between the control circuit and a point upstream of the plurality of switch sets.

13. The device of claim 1, further comprising a pair of load-side diodes coupled between the control circuit and a point downstream of the plurality of switch sets.

14. A system comprising:

a switching circuitry comprising a micro-electromechanical system switch configured to switch the system from a first switching state to a second switching state;

a voltage draining circuitry coupled to the switching circuitry, wherein the voltage draining circuitry comprises at least one pair of diodes and is configured to drain a voltage at contacts of the switching circuitry, wherein the at least one pair of diodes comprises at least one of a line-side diode, a load-side diode, or an intermediate diode comprising a lower rating than the line-side diode or the load-side diode; and a control circuitry coupled to the voltage draining circuitry, wherein the control circuitry is configured to supply a pulse signal, and wherein the pulse signal is applied to the voltage draining circuitry to initiate an operation of the switching circuitry.

15. The system of claim 14, further comprising a grading network coupled in parallel with the switching circuitry, the grading network adapted to distribute uniform voltage across the switching circuitry.

16. The system of claim 14, wherein the pulse signal is configured to forward bias the at least one pair of diodes.

17. The system of claim 15, wherein the grading network further comprises at least one of a metal oxide varistor or a resistor.

18. The system of claim 17, wherein the metal oxide varistor is further configured to restrain a rate-of-change of a voltage that develops across the switching circuitry.

19. A method comprising:

triggering a current pulse into at least one pair of diodes via a control circuit, wherein the at least one pair of diodes are coupled between a plurality of micro-electromechanical system switch sets coupled in series at common points and the control circuit, and wherein each switch set comprises a plurality of switches coupled in parallel between a first common point and a second common point and the at least one pair of diodes are coupled between a common point and the control unit;

biasing the at least one pair of diodes based upon the triggering; and discharging a voltage across the plurality of switch sets via biasing of the at least one pair of diodes.

20. The method of claim 19, wherein the current pulse enables biasing the at least one pair of diodes.

21. The method of claim 19, further comprising channeling a bulk of current through a plurality of line-side diodes and a plurality of load-side diodes.

22. The method of claim 19, further comprising absorbing inductive energy in at least one of the plurality of switch sets.

23. The method of claim 19, further comprising distributing the voltage equally across the plurality of switch sets via a grading network.

* * * * *